United States Patent [19]

Lengers

[11] Patent Number: 4,797,967

[45] Date of Patent: Jan. 17, 1989

[54] PADDED GENERAL PURPOSE MITTEN AND METHOD OF FABRICATING SAME

[75] Inventor: Hans L. Lengers, Charlotte, N.C.

[73] Assignee: U.S. Textiles Corporation, Charlotte, N.C.

[21] Appl. No.: 105,406

[22] Filed: Oct. 5, 1987

[51] Int. Cl.[4] ..... A47L 13/18

[52] U.S. Cl. ..... 15/227; 2/158; 15/118

[58] Field of Search ..... 15/104 A, 105, 118, 15/208, 209 A, 209 R, 227; 2/158, 169

[56] References Cited

U.S. PATENT DOCUMENTS

| | | | |
|---|---|---|---|
| 1,547,583 | 7/1925 | Holden | 15/227 |
| 1,579,479 | 4/1926 | Holden | 15/227 |
| 1,782,502 | 11/1930 | Crane | 15/227 |
| 3,711,889 | 1/1973 | Jennings | 15/227 |
| 4,510,640 | 4/1985 | Omori | 15/208 |

FOREIGN PATENT DOCUMENTS

| | | | |
|---|---|---|---|
| 17678 | of 1913 | United Kingdom | 15/227 |

*Primary Examiner*—Harvey C. Hornsby
*Assistant Examiner*—Corinne M. Reinckens
*Attorney, Agent, or Firm*—Shefte, Pinckney & Sawyer

[57] ABSTRACT

A general purpose cleaning and polishing mitten is fabricated from a tubular fabric blank by seaming one end closed, filling half the blank with padding, forming another seam adjacent the padding to enclose it, everting the remaining extent of the blank over the padded extent and forming a partial longitudinal seam from the transverse seam, thereby forming interior hand pockets with fingertip areas at opposite sides of the padding.

15 Claims, 3 Drawing Sheets

PADDED GENERAL PURPOSE MITTEN AND METHOD OF FABRICATING SAME

BACKGROUND OF THE INVENTION

The present invention relates generally to mitt or mitten constructions and methods of fabricating same and, more particularly, to a padded mitten useful for polishing and like purposes and a method of fabricating same.

Various forms of mitt or mitten constructions designed for wearing on one's hand have heretofore been proposed for use in performing various household and related tasks, such as polishing, cleaning, scrubbing and the like. Representative examples of such mittens are disclosed in U.S. Pat. Nos. 1,882,179; 2,034,169; 3,608,708; 3,638,789; 4,071,921 and 4,670,930.

SUMMARY OF THE INVENTION

It is an object of the present invention to provide an improved mitten of an inexpensive padded construction suitable for various household uses, and a novel method by which such padded mitten may be conveniently constructed.

Briefly summarized, the padded mitten of the present invention is formed from a tubular length of fabric closed at one longitudinal end and closed transversely at a spacing from the closed end with a suitable quantity of padding enclosed within the lengthwise fabric portion therebetween. The remaining lengthwise portion of the fabric is everted over its enclosed lengthwise portion for forming interior hand pockets therebetween at opposite sides of the enclosed lengthwise portion for selective insertion of a user's hand at opposite sides of the padding.

Preferably, a length of circularly-knitted tubular textile fabric is utilized for the mitten, and is provided with a first seam across one longitudinal end to close the end and a second transverse seam at a spacing from the closed end. The padding, preferably a fibrous batt, is enclosed within the knitted fabric between the two seams. With the remaining lengthwise portion of the fabric everted over the enclosed padded portion, a longitudinal seam extends from the transverse seam and joins each opposite side of the enclosed padded portion to the remaining lengthwise portion to define finger-receiving areas within each hand pocket. An annular cuff portion is preferably formed at the longitudinal end of the fabric opposite its closed end, for snug engagement about the wrist of a wearer.

The padded mitten of the present invention is fabricated by the steps of initially providing a suitable tubular length of fabric with one closed longitudinal end, inserting padding in a first lengthwise portion of the fabric adjacent its closed end, transversely closing the fabric adjacent its first lengthwise portion to enclose the padding, and everting the remaining lengthwise portion of the fabric over its first lengthwise portion to form the aforesaid interior hand pockets therebetween at opposite sides of the first lengthwise portion.

In the preferred manner of carrying out the above-described method, the tubular length of fabric is initially circularly-knitted and a seam is formed across one end to close such end. After inserting the padding, another seam is formed transversely of the fabric length to join opposite sides thereof adjacent its first lengthwise portion, thereby enclosing the padding. After everting the remaining lengthwise portion of the fabric over its first lengthwise portion, a longitudinal seam is formed from the transverse seam to join each opposite side of the first lengthwise portion to the remaining lengthwise portion to define finger receiving areas within each of the hand pockets.

DESCRIPTION OF THE PREFERRED EMBODIMENT

Figure 1:
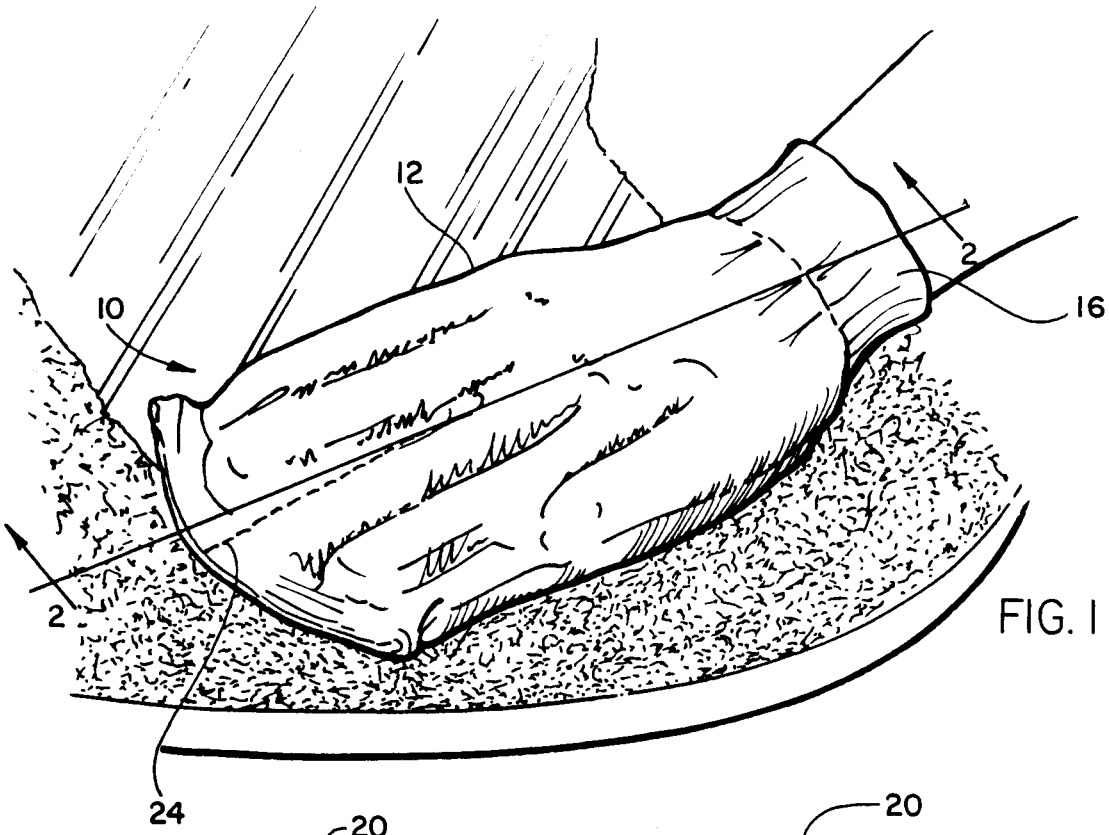
FIG. 1 is a perspective view of a mitten according to the preferred embodiment of the present invention.
Figure 2:
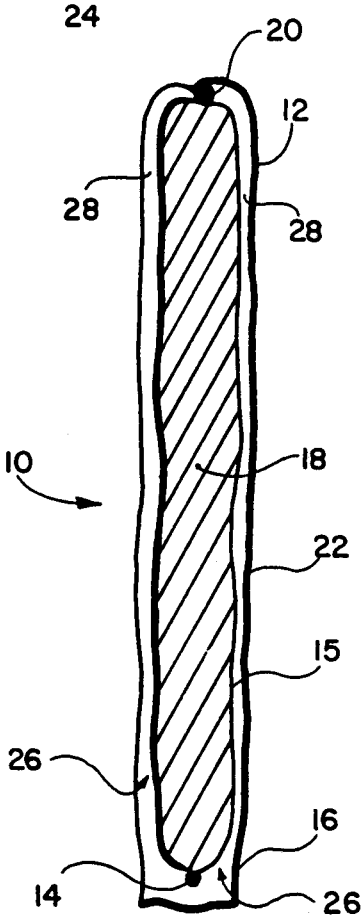
FIG. 2 is a vertical cross-sectional view of the mitten of FIG. 1 taken along line 2—2 thereof.

Referring now to the accompanying drawings and initially to FIGS. 1 and 2, a padded polishing and cleaning mitten according to the preferred embodiment of the present invention is generally indicated at 10. The mitten has a tubular fabric body 12 preferably formed of a tubular length of circularly-knitted fabric. For example, a common article of ladies' circularly-knitted knee-high hosiery has been found to be particularly suitable for use as the fabric body 12. A seam 14 is sewn across one longitudinal end of the fabric body 12 to close such end, as in the common technique of seaming closed the open toe portion in circularly-knitted hosiery. The opposite longitudinal end of the fabric body is preferably formed with an elasticized annular cuff portion 16. A quantity of suitable padding 18, such as a fibrous batt of cotton, synthetic or other suitable fibers, is enclosed within approximately one-half the length of the tubular fabric body 12 adjacent its closed end and another seam 20 is formed transversely across the central region of the fabric body 12 immediately adjacent the padding 18 to join the opposite sides of the fabric body 12 and thereby enclose the padding 18 within the lengthwise portion of the fabric body 12 between the seams 14,20, indicated at 15. The remaining approximately one-half extent of the length of the fabric body 12, indicated at 22, is everted over the padded fabric portion 15 and a longitudinal seam 24 is sewn completely through the composite article extending a short distance from the approximate center of the transverse seam 20.

In this manner, the mitten 20 defines a pair of hand pockets 26 respectively between the opposite sides of the padded lengthwise fabric portion 15 and the facing everted sides of the remaining lengthwise portion 22 of the fabric body 12, with the longitudinal seam 24 defining two fingertip receiving areas 28 within each pocket 26. Thus, a user's hand may be inserted in either pocket 26 with the forefinger and middle finger received within one fingertip area 28 and with the ring finger and small finger received within the other fingertip area 28, the cuff portion 16 snugly engaging the user's wrist to assist in holding the mitten 10 in place. Accordingly, the outwardly facing surface of the everted portion 22 of the fabric body 12 at each opposite side of the mitten 10 is usable for cleaning, scrubbing, polishing and like household tasks by alternating the user's hand between the two pockets 26 and, in each case, the padding 18 is disposed between the user's hand and the effective side of the everted fabric portion 22 for assisting in the task.

Figure 5:
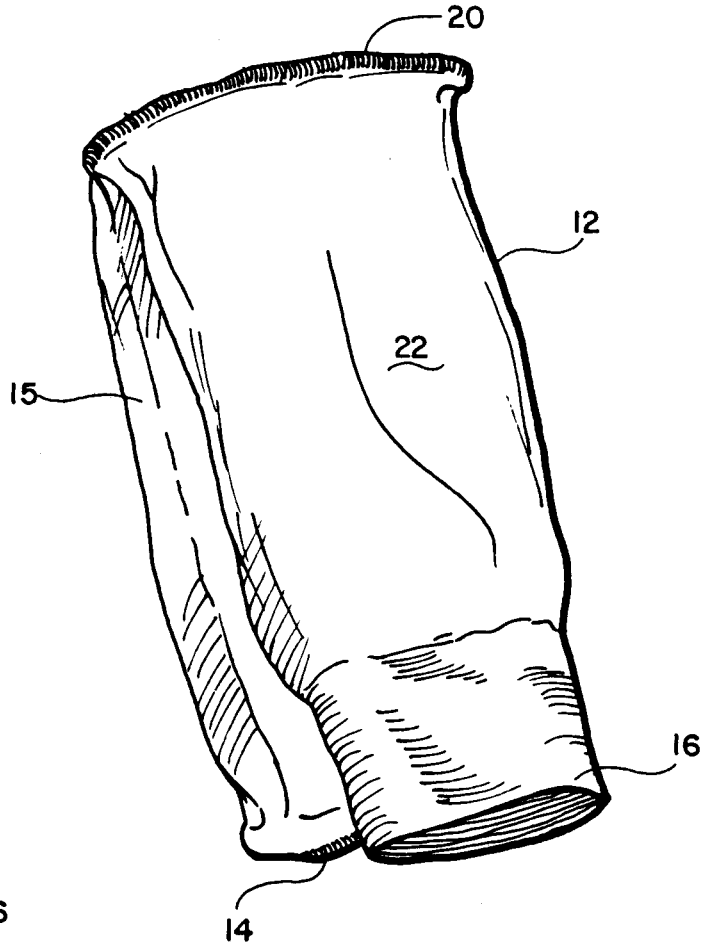
FIGS. 4–7 are sequential views illustrating the steps in fabricating the mitten of FIG. 1 from the tubular fabric blank of FIG. 3.
Figure 4:
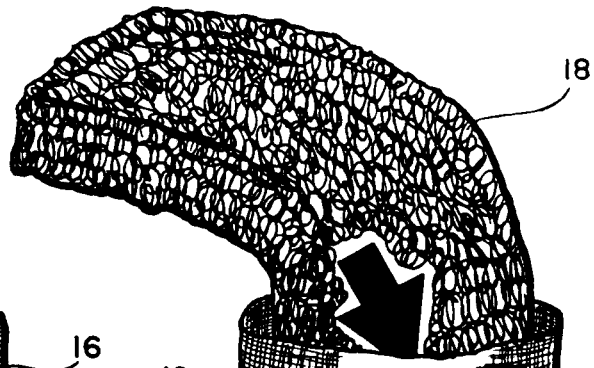
Figure 3:
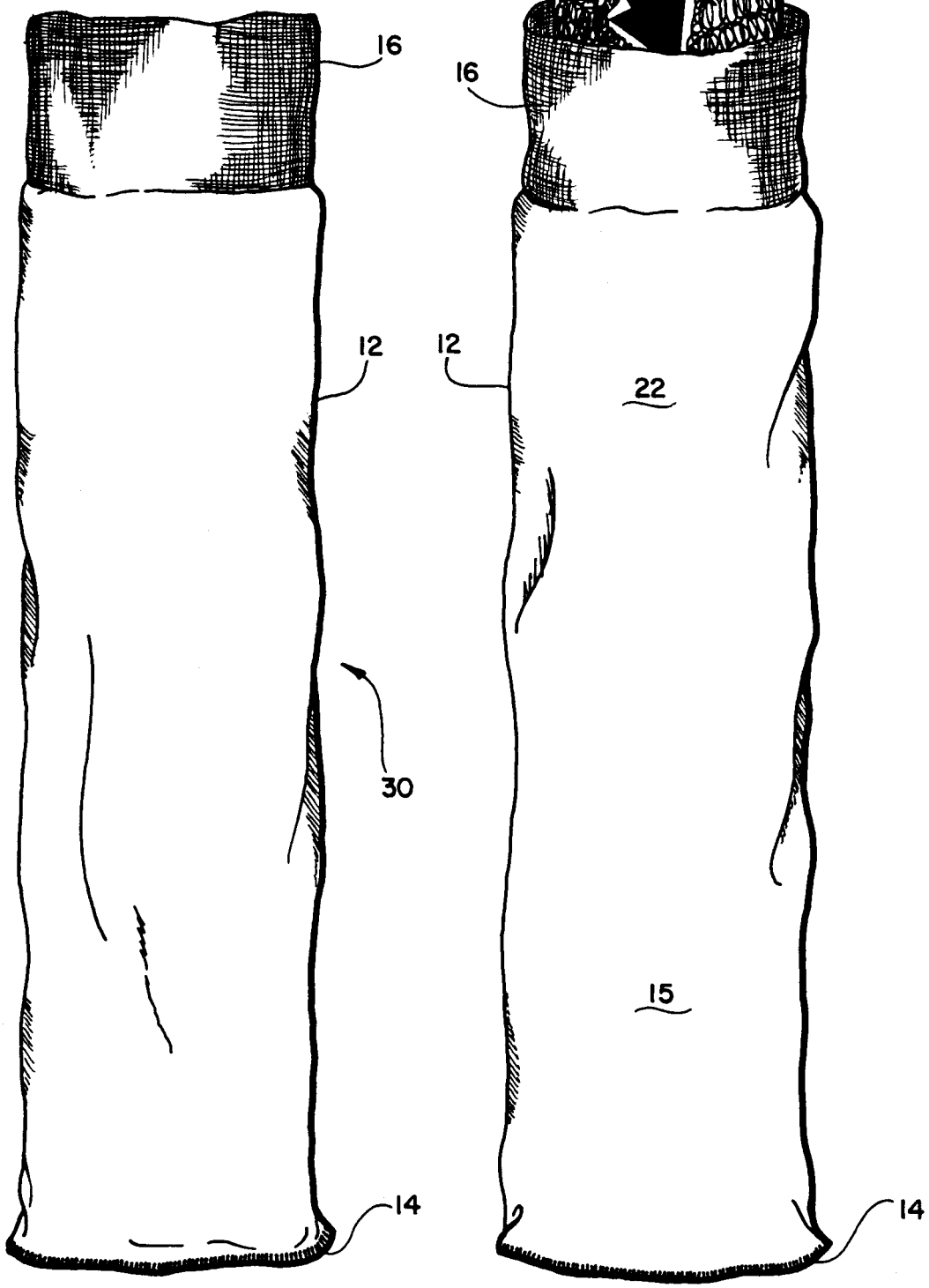
FIG. 3 is a perspective view of a tubular fabric blank of the type utilized in the construction of the mitten of FIG. 1.
Figure 7:
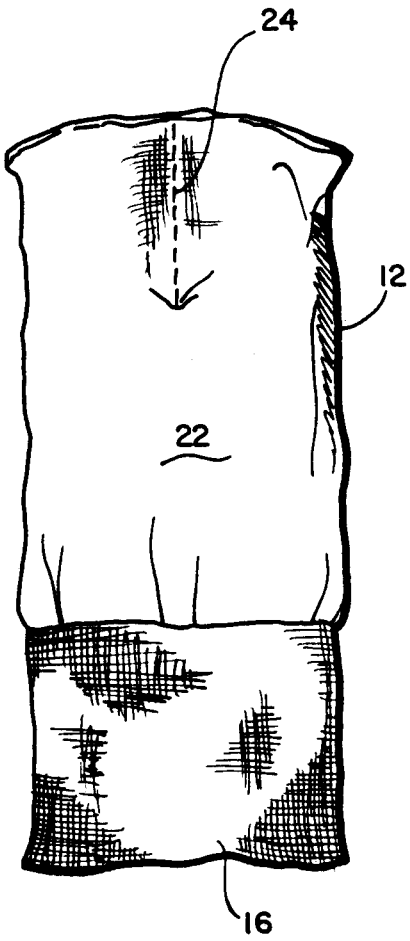
Figure 6:
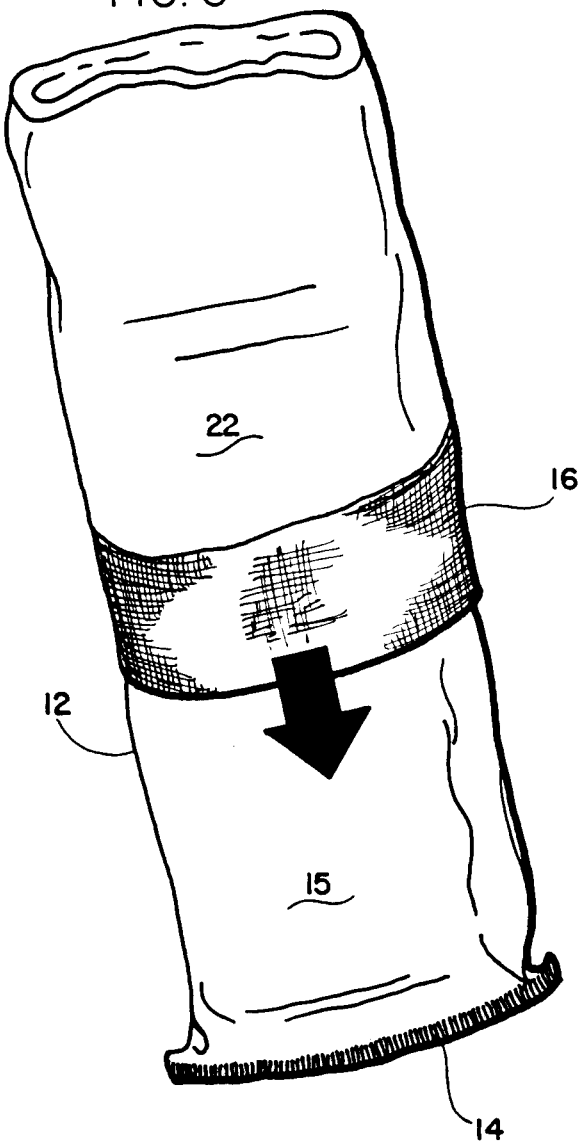

With reference now to FIGS. 3–7, the method of the present invention by which the mitten 10 is fabricated may be understood. Initially, a tubular fabric blank suitable for use as the fabric body 12 is formed, preferably by circularly-knitting a tubular blank such as a tubular knee-high hosiery blank as illusrtated at 30 in FIG. 3. The hosiery blank 30 has an elasticized cuff portion 16 at one end, with the opposite fabric end seamed closed at 14. Of course, as those persons skilled in the art will readily recognize, any other tubular fabric construction may of course by equally well employed in fabricating the mitten of the present invention. Next, a quantity of fibrous batting or other suitable padding 18 is inserted through the cuff end of the tubular blank 30 to occupy approximately one-half the length of the blank interior adjacent its closed end, as represented in FIG. 4. The remaining approximately one-half extent of the fabric blank 30 is then folded over the padded fabric extent and a transverse seam is formed at 20 along the fold, as depicted in FIG. 5. Upon completion of the seam, the folded extent of the blank 30 is everted annularly about the padded fabric extent, as shown in FIG. 6, until the cuff portion 16 substantially encircling the closed end of the padded fabric extent. Then, a longitudinal seam is formed at 24 through the entirety of the composite article a short distance, e.g. two inches, from the approximate center of the seam 20, as depicted in FIG. 7.

It will accordingly be understood that the present invention provides a simple and convenient manner of inexpensively fabricating a general purpose padded mitten utilizing readily available materials. Hosiery blanks, such as the blanks 30, and other similar tubular fabric blanks are currently in mass production by numerous hosiery producers and may be readily fabricated at minimal expense. Similarly, any suitable fibrous or other appropriate padding material may be utilized for the padding 18. By way of example, waste cotton produced as a by-product in conventional textile processing may be utilized as the padding 18. The steps required in the fabrication of the mitten 10 from such materials merely require conventional sewing equipment and may be carried out with minimal training by essentially unskilled workers. Further, the construction of the mitten 10 provides substantial advantages over conventional cleaning and scrubbing cloths, brushes and the like as well as being superior to conventional mittens such as those indicated above. The provision of the alternate hand pockets enables each opposite outside surface of the mitten 10 to be fully utilized, while the fingertip areas in the pockets together with the elasticized cuff, assist in providing a secure fit of the mitten 10 to the user's hand without slippage or free movement of the mitten with respect to the hand.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method of fabricating a padded mitten useful for polishing, cleaning and like uses, comprising the steps of providing a tubular length of fabric having one longitudinal end thereof closed, inserting padding means in a first lengthwise end portion of said fabric at its closed end, transversely closing said fabric at a medial location defining said first lengthwise end portion and enclosing said padding means therein, and everting the remaining lengthwise portion of said fabric over its first lengthwise portion to form interior hand pockets therebetween at opposite sides of said first lengthwise portion for selective insertion of a user's hand at opposite sides of said padding means.

2. A method of fabricating a padded mitten according to claim 1 and characterized further in that said providing said tubular length of fabric includes circularly knitting said fabric.

3. A method of fabricating a padded mitten according to claim 2 and characterized further in that said providing said tubular length of fabric includes forming a seam across said one end of said fabric to close said end.

4. A method of fabricating a padded mitten according to claim 3 and characterized further in that said circularly knitting said fabric includes forming an annular cuff portion at the opposite longitudinal end of said fabric.

5. A method of fabricating a padded mitten according to claim 1 and characterized further in that said transversely closing said fabric includes forming a seam transversely of the length of said fabric for joining opposite sides thereof.

6. A method of fabricating a padded mitten according to claim 5 and characterized further by, prior to said forming said transverse seam, folding said remaining lengthwise portion of said fabric over said first lengthwise portion of said fabric at the desired location of said transverse seam.

7. A method of fabricating a padded mitten according to claim 1 and characterized further in that, following said everting, forming a longitudinal seam extending from the location of transverse closing for joining each opposite side of said first lengthwise portion to said remaining lengthwise portion to define finger receiving areas within each said hand pocket.

8. A padded mitten useful for polishing cleaning and like uses, comprising a tubular length of fabric closed at one longitudinal end and closed transversely at a spacing from said closed end for defining an enclosed lengthwise fabric portion therebetween, padding means enclosed within said enclosed lengthwise portion of said fabric, and the remaining lengthwise portion of said fabric being everted over its enclosed lengthwise portion for forming interior hand pockets therebetween at opposite sides of said enclosed lengthwise portion for selective insertion of a user's hand at opposite sides of said padding means.

9. A padded mitten according to claim 8 and characterized further in that said tubular length of fabric is circularly knitted with a seam across said one end closing said one end.

10. A padded mitten according to claim 9 and characterized further in that the opposite longitudinal end of said fabric includes an annular cuff portion.

11. A padded mitten according to claim 8 and characterized further in that said fabric is transversely closed by a seam formed transversely of the length of said fabric for joining opposite sides thereof.

12. A padded mitten according to claim 8 and characterized further by a longitudinal seam extending from the transversely closed location of said fabric and joining each opposite side of said enclosed lengthwise portion to said remaining lengthwise portion for defining finger receiving areas within each said hand pocket.

13. A padded mitten according to claim 8 and characterized further in that said padding means comprises a firbrous batt.

14. A method of fabricating a padded mitten useful for polishing, cleaning and like uses, comprising the steps of:

circularly knitting a tubular length of textile fabric and forming a seam across one end thereof to close said one end, inserting padding means in a first lengthwise end portion of said fabric at its closed end, forming another seam transversely of the length of said fabric at a medial location for joining opposite sides thereof to define said first lengthwise portion to enclose said padding means therein, everting the remaining lengthwise portion of said fabric over its first lengthwise portion to form interior hand pockets therebetween at opposite sides of said first lengthwise portion for selective insertion of a user's hand at opposite sides of said padding means, and forming a longitudinal seam extending from said transverse seam joining each opposite side of said first lengthwise portion to said remaining lengthwise portion to define finger receiving areas within each said hand pocket.

15. A padded mitten useful for polishing, cleaning and like uses, comprising a tubular length of circularly knitted textile fabric having a first seam across one longitudinal end closing said one end and a second seam transversely of the length of said fabric at a spacing from said one end defining an enclosed lengthwise fabric portion therebetween, padding means enclosed within said enclosed lengthwise portion of said fabric, the remaining lengthwise portion of said fabric being everted over its enclosed lengthwise portion for forming interior hand pockets therebetween at opposite sides of said enclosed lengthwise portion for selective insertion of a user's hand at opposite sides of said padding means, and a longitudinal seam extending from said transverse seam and joining each opposite side of said enclosed lengthwise portion to said remaining lengthwise portions for defining finger receiving areas within each said hand pocket.

* * * * *